United States Patent [19]

Wallace et al.

[11] 4,265,108

[45] May 5, 1981

[54] PNEUMATIC NUT RUNNER WITH TORQUE INDICATOR

[75] Inventors: William K. Wallace, Barneveld; David A. Giardino, Deerfield, both of N.Y.

[73] Assignee: Chicago Pneumatic Tool Company, New York, N.Y.

[21] Appl. No.: 26,458

[22] Filed: Apr. 2, 1979

[51] Int. Cl.[3] ..... B25B 23/145

[52] U.S. Cl. ..... 73/862.21

[58] Field of Search ..... 73/139, 1 C

[56] References Cited

U.S. PATENT DOCUMENTS

| | | | |
|---|---|---|---|
| 2,320,023 | 5/1943 | Zimmerman | 73/139 |
| 2,614,418 | 10/1952 | Shaff | 73/139 |
| 2,614,419 | 10/1952 | Shaff | 73/139 |
| 3,108,472 | 10/1963 | Scyocurka | 73/139 |

*Primary Examiner*—Charles A. Ruehl

*Attorney, Agent, or Firm*—Stephen J. Rudy

[57] ABSTRACT

A pneumatically powered hand-held torque wrench having a dial gage arranged on the handle portion of the wrench to display the amount of torque exerted upon a fastener by the tool. A pointer indicates the tool maximum torque attained during tool operation, including manual torquing effort by the tool operator, which pointer maintains maximum torque read-out until the pointer is reset by the operator. A mechanical linkage arrangement transmits tool handle flexure into rotation of the dial gage to indicate maximum torque value developed upon a fastener being worked upon.

10 Claims, 6 Drawing Figures

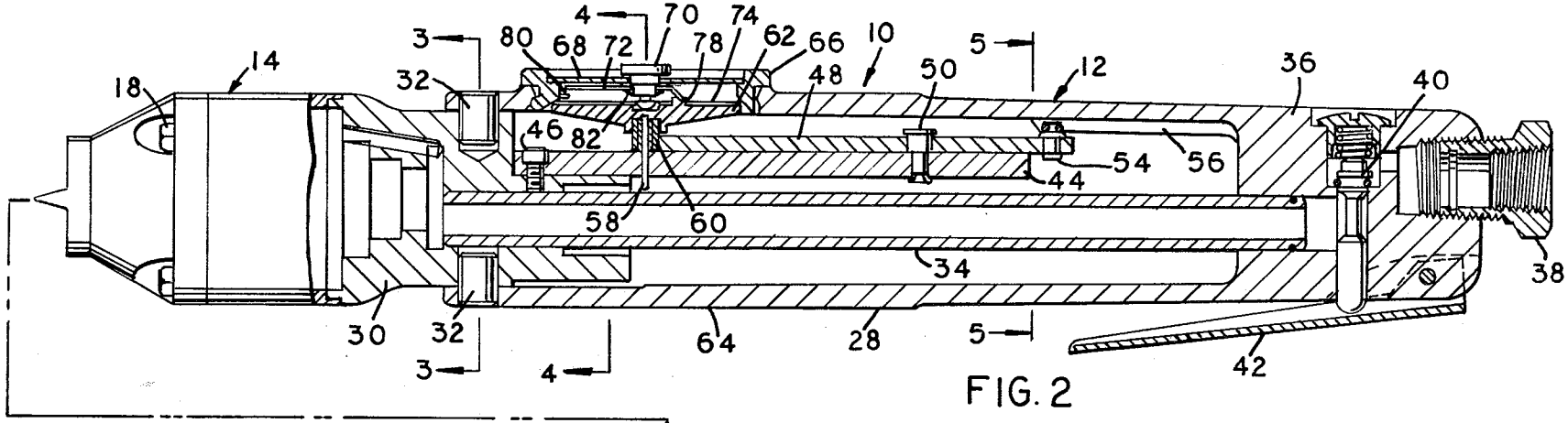
FIG. 2
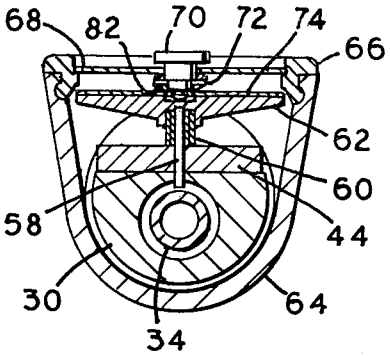
FIG. 4
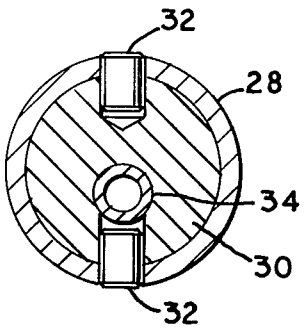
FIG. 3
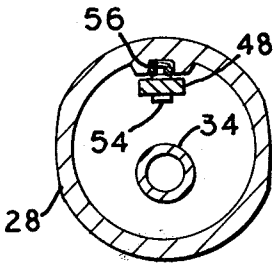
FIG. 5
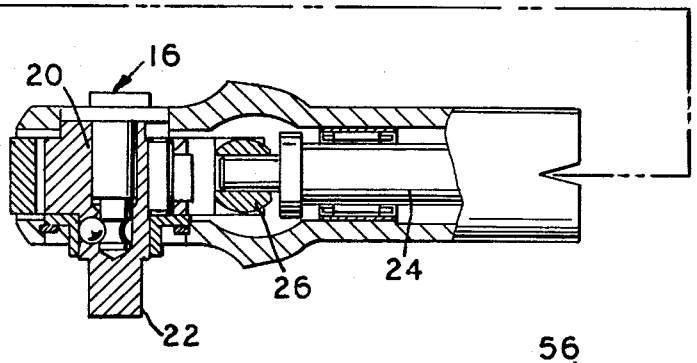

PNEUMATIC NUT RUNNER WITH TORQUE INDICATOR

BACKGROUND OF THE INVENTION

This invention relates to pneumatically powered hand-held torque wrenches having means for measuring and displaying the amount of torque applied to a fastener.

The structure and operational characteristics of the wrench per se are known in the art, for example, as disclosed in U.S. Pat. No. 3,621,738, granted to O. V. Northcutt on Nov. 23, 1971. This invention concerns the addition of a torque measuring and display means on a wrench of the type disclosed in said patent.

A feature of the invention resides in the fact that after a fastener setting operation, the torque reading will be maintained until reset by the operator.

Another feature of the invention is that the tool operator can see the value of torque as it is being developed during tool operation.

Still another feature is that the torque developed by the tool can be measured in a forward as well as a reverse direction, and with or without pressurized medium being supplied to the tool.

Another feature of the tool of the invention is use of a simple torque tube to provide resistance force to tool handle flexure, which torque tube also serves as a pressure medium conduit for the tool motor.

A further feature of the tool is simplicity in structural detail and operational characteristics, as well as a tool which will provide accurate torque read-out and long, trouble-free service.

Other features and advantages of the invention over known prior art devices, will be evident from the invention disclosure which follows:

BRIEF DESCRIPTION OF THE DRAWINGS

FIG. 2 is an enlarged partial section as seen from line 2—2 in FIG. 1;

FIG. 3 is a section view as seen from line 3—3 in FIG. 2;

FIG. 4 is a section view as seen from line 4—4 in FIG. 2;

FIG. 5 is a section view as seen from line 5—5 in FIG. 2; and

DESCRIPTION OF THE PREFERRED EMBODIMENT

Figure 1:
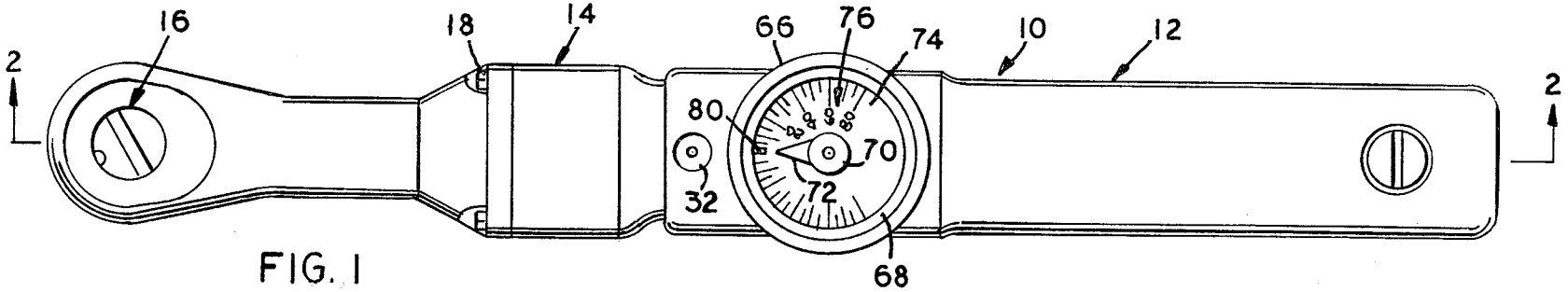
FIG. 1 is a top view of a wrench embodying the invention.
Figure 6:
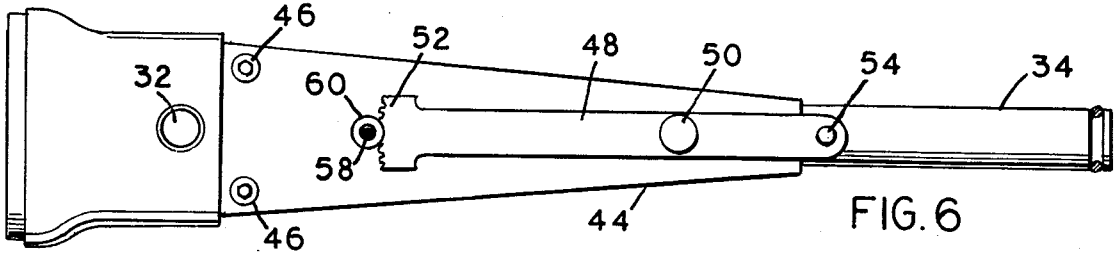
FIG. 6 is a top view of a torque transmitting linkage member arrangement as used in the tool of FIG. 1.

Referring now to the drawings, FIG. 1 illustrates a tool 10 embodying the principles of the invention, which tool includes a handle portion 12, a motor portion 14, and a work engaging portion 16, all portions normally being in axial alignment in non-operative tool condition. The portions 14 and 16 include structural detail which is known in the prior art, such as in U.S. Pat. No. 3,621,738, and no detail description is believed necessary for a clear understanding of the subject invention. The work engaging portion is affixed to the motor portion 14, by bolts 18, and includes a reversable ratchet mechanism 20, which drives a shank 22 for rotation of a fastener (not shown). The ratchet mechanism 20 is operated by a crankshaft 24, the end of which is eccentrically arranged in a drive bushing 26 having the form of a ball. The crankshaft is rotated by a sliding vane motor arranged in the motor portion 14.

The handle portion 12 is in the form of a cylindrical housing 28, one end of which is enclosed, the other end being open and mounted upon a rear extension 30 of the motor portion and secured thereon by two diametrically arranged pins 32. Slight clearance between the housing and the rear extension is provided to allow a change in axial alignment between said parts when rotating force is applied to the handle portion. If the housing is made of material sufficiently flexible under the manual force exerted upon the handle portion in tool operation, such inter-fit clearance can be dispensed with. A torque tube 34 is enclosed in the handle portion 12, one end of the tube being mounted in the rear extension 30, the other end being mounted in a solid part 36 forming the enclosed end of the cylinder 28. Pressure medium i.e., compressed air, is admitted to the tool by means of hose coupling 38, and air flow control effected by a throttle valve 40 movable by a handle 42 pivotally secured to the handle portion 12. The valve is spring biased toward seated position. Air flowing past the throttle valve 40 enters the torque tube 34 and leaves at the forward end after which it powers the motor and is exhausted to atmosphere, in well known manner.

A truncated platform 44 is secured at one end to the rear extension 30 by cap screws 46, which platform extends in paralled relation to the torque tube 34, as best seen in FIG. 2. A gear platform 48 is mounted atop the platform 44, and is fixed for rotary movement about a pivot pin 50 secured to the platform 44. One end of the gear platform 48 has a gear toothed portion 52, while the other end has a pin 54, the free end of which is arranged to extend into a longitudinal groove 56 formed on the inner surface of handle cylinder 28. The free end of the gear platform could be arranged in contact with the torque tube 34 to provide platform rotation during fastener torquing, as will be evident.

An elongated pin 58 is affixed to the platform 44 and projects upwardly therefrom. A driver gear 60 is arranged upon the pin 58, the lower portion of the gear 60 being in working engagement with gear platform tooth portion 52, while the upper part supports a dial platform 62. The handle portion 12 is formed with a cylindrical portion 64, the axis of which coincides with the axis of elongated pin 58. A bezel 66, supporting a lens 68, is secured to the cylindrical portion 64 at the upper extremity thereof, and is arranged to be manually rotated. A reverse button 70 is mounted upon the lens 68, the lower portion of the button having a pointer 72 affixed thereto. The dial platform 62 supports a dial 74 having indicia 76 representing torque read-out values, as best seen in FIG. 1. Note that the torque values are symmetrically arranged on each side of zero value from 10 to 70 ft.-lbs. of torque indication.

Extending from the dial platform and through a hole in the dial 74, is a small projection 78, which is arranged to serve as an abutment against the short end of the pointer 72, which is bent, as shown in FIG. 2. A small pin 80 is affixed to the inner surface of the bezel 66 and projects over the dial 74, however, the long end of the pointer 72 is free to move past the pin 80 without interference. A disc spring 82 is secured to the lower part of the reverse button 70, and functions to hold the pointer 72 in position until reset by the operator after a torque read-out operation.

When manual force is applied to the tool handle, the crankshaft 24 will be rotated to a dead position, which is in line with the direction of the applied force. This causes manual torque load to be taken by the tool handle and flex the tube 34 and handle portion 12. Such action results in movement of the gear platform 48 about pivot pin 50, and rotation of the dial platform 62 by reason of engagement of the driver gear 60 and platform toothed portion 52. As a result, the dial 74 is rotated, and when torquing effort is terminated, the pointer 72 will remain at maximum torque value achieved.

It will be seen that when torque load is applied to the tool, rotary movement of dial 74 will cause the small pin 80 to indicate torque value on one set of indicia 76, and when torque load is released, the pointer 72 will indicate torque on the opposite set of indicia 76. In such manner, the tool operator can observe the torque value being developed, and will have a pointer indication of such torque value after torque load is released. Since the tool is reversible, such torquing feature of the tool will be obtained in either direction of rotation of a fastener being worked upon.

OPERATION OF DISCLOSED TOOL

Assume that the tool is in operative position to run up and set a fastener, with the pointer 72 being set at "0" torque reading. Compressed air is admitted to the motor when the throttle lever 42 is depressed, and the fastener is rotated until the motor stalls as the fastener is seated. The pointer 72 will be rotated to indicate value of stall torque by reason of the rotary movement of the dial platform 62, said pointer rotation being effected by the projection 78 engaging the bent end of the pointer.

The operator may then increase applied torque by exerting manual force upon the tool handle until desired developed torque is achieved, as shown by the pointer 72 indicating the torque value on the dial 74. Upon release of force upon the tool handle, the pointer will remain in torque read-out position until reset by the operator.

It will be appreciated that the tool will function equally well, as far as torque read-out is concerned, with or without use of compressed air, that is, manual force alone will produce torque read-out values within the tool range capacity.

While an embodiment of the invention has been illustrated and described in detail, it is to be expressly understood that the invention is not limited thereto. Various changes in form, design or arrangement may be made in its parts without departing from the spirit and scope of the invention; it is my intention, therefore, to claim the invention not only as shown and described, but also in all such forms and modifications thereof as might be reasonably construed to be within the spirit of the invention and the scope of the appended claims.

We claim:

1. In a torque read-out pneumatically powered hand-held tool for setting fasteners, said tool having in axial alignment a handle portion, a motor portion and a work engaging portion, an improvement comprising a torque read-out means including a rotatable torque indicating dial arranged on the handle portion, and a linkage means enclosed in the handle portion, one end of the linkage means arranged in operative engagement with the dial, the other end of the linkage means being arranged for movement responsive to change in axial alignment between the motor portion and the handle portion resulting from torque developed on a fastener by the tool at the work engaging portion whereby the dial is rotated to indicate said torque.

2. In a tool according to claim 1, wherein a torque tube is affixed at one end of the motor portion and at the other end to an enclosed end of the handle portion, said torque tube being arranged to resist change in axial alignment between the motor portion and the handle portion.

3. In a tool according to claim 2, wherein said torque tube is arranged to conduct pressurized air from the handle portion to the motor portion to cause operation of a motor therein.

4. In a tool according to claim 3, wherein the handle portion is pivotally affixed to the motor portion with clearance therebetween to allow said change in axial alignment.

5. In a tool according to claim 4, wherein the linkage means includes a first platform which is enclosed by the handle portion and has one end secured to the motor portion, a gear platform arranged on the first platform and pivotally affixed thereto, said gear platform having a gear portion at one end adapted to operatively engage a driver gear affixed to a dial platform supporting the dial, said gear platform being engageable with the handle portion, the arrangement of said platforms providing conversion of amount of change in axial alignment between the motor portion and the handle portion into rotation of the dial to indicate torque being developed by the tool upon a fastener.

6. In a tool according to claim 5, wherein a bezel is rotatably mounted in a cylindrical portion formed on the handle portion, which bezel supports a lens covering the dial, a reverse button rotatably mounted on the lens and projecting therethrough toward the dial, and a pointer arranged between the lens and the dial and connected to the reverse button.

7. In a tool according to claim 6, wherein the dial platform has a projection which extends through the dial and is positioned for engagement with an end of the pointer in either direction of rotation of the dial.

8. In a tool according to claim 7, wherein the dial has indicia comprising two groups of sequential torque values symmetrically arranged in a circumferential pattern.

9. In a tool according to claim 8, wherein a pin is affixed to the bezel beneath the lens and projects radially over the dial which pin provides torque read-out when the tool is operating on a fastener.

10. In a torque read-out pneumatically powered hand-held tool for setting fasteners, said tool having in axial alignment a handle portion, a motor portion, and a work engaging portion including a ratchet type wrench for rotation of a fastener, which wrench is operated by a motor enclosed in the motor portion, an improvement comprising a torque read-out means including a rotatable torque indicating dial positioned in a cylindrical portion formed on the handle portion, a linkage means enclosed in the handle portion, and a torque tube arranged in the handle portion and affixed to the motor portion at one end and to the inside of the handle portion at the other end, said torque tube being arranged to resist change in axial alignment between the motor portion and the handle portion when the motor stalls during tool operation and manual force is applied to the handle portion, said linkage means being arranged to rotate the torque indicating dial in proportion to the value of rotational force being applied to a fastener operated upon by the tool.

* * * * *